United States Patent [19]

Russell

[11] 3,990,619

[45] Nov. 9, 1976

[54] FASTENER ATTACHMENT NEEDLE

[75] Inventor: David Bates Russell, Southborough, Mass.

[73] Assignee: Dennison Manufacturing Company, Framingham, Mass.

[22] Filed: Nov. 12, 1975

[21] Appl. No.: 631,066

[52] U.S. Cl. ..... 227/67; 227/76

[51] Int. Cl.[2] ..... B25C 7/00

[58] Field of Search ..... 227/67, 68, 70, 71, 227/72, 76; 112/104, 125; 128/214.4, 221; 223/102, 103, 104

[56] References Cited

UNITED STATES PATENTS

| | | | |
|---|---|---|---|
| 1,239,496 | 9/1917 | McChesney | 227/67 |
| 2,092,929 | 9/1937 | Ovington | 223/102 |
| 3,754,693 | 8/1973 | Herr | 223/102 |
| 3,872,806 | 3/1975 | Bone | 227/67 |
| 3,892,240 | 7/1975 | Park | 223/102 |
| 3,895,753 | 7/1975 | Bone | 227/67 |

*Primary Examiner*—Granville Y. Custer, Jr.
*Attorney, Agent, or Firm*—Thompson, Birch, Gauthier & Samuels

[57] ABSTRACT

An improved hollow needle is provided for inserting through a material a fastener having a flexible filament with a retaining cross-bar at one end. The improved needle has an end for penetrating the material, a hollow central bore for slidably receiving the fastener cross-bar, a longitudinal slot along one side of the bore for slidably receiving the filament, and an upstanding flange at or adjacent one or preferably both edges of the slot for protecting the material and/or filament from damage during insertion of the fastener.

9 Claims, 10 Drawing Figures

FASTENER ATTACHMENT NEEDLE

BACKGROUND OF THE INVENTION

This invention relates to a new and improved needle for dispensing flexible fasteners of a type designed to be inserted through an object for tagging or for joining two objects together. Such fasteners, together with apparatus for applying them, have gained wide public acceptance in industrial and consumer applications, e.g. for the attachment or recoupling of buttons to garments, for ticket tagging in retail establishments, for the pairing of related items such as shoes and socks, and in industrial applications for the temporary or permanent joining of materials. They are shown in numerous references, including among others, U.S. Pat. Nos. 3,103,666; 3,399,432; 3,380,122; 3,444,597; 3,457,589; 3,470,834; 3,659,769; 3,733,657; 3,759,435; 3,875,648; 3,893,612; and 3,895,753.

As shown in the above cited references, the disclosures of which are incorporated herein by reference, the flexible fasteners are usually of integral plastic construction and comprise a thin flexible filament having a retaining cross-bar or end-bar at one end and an enlarged head at the other end which can be of any desired configuration, for example an enlarged flat area (U.S. Pat. No. 3,103,666), an enlarged head for association with an opening in a button (U.S. Pat. No. 3,399,432), or a second cross-bar or end-bar (U.S. Pat. No. 3,875,648). Individual attachments may be joined together to form assemblies, clips, magazines, or extended rolls from which single fasteners are detached by severing or cutting as needed. The filaments may be stretched to reduce their cross-section and increase their strength, and may be tapered or provided with a narrowed section adjacent the first cross-bar to facilitate initial preferential stretching at that portion of the filament.

As also shown in the foregoing references, the fastener is inserted through the article or material to be joined or identified by the use of a hollow needle. The needle is normally mounted in a tool and comprises a point at one end for penetrating the material, a central bore extending therethrough for slidably receiving the cross-bar, and a longitudinal slot communicating with the bore from which the fastener filament projects. In use, the needle is pushed through the material or articles to be joined or tagged, the cross-bar or end-bar of the fastener pushed through the bore of the needle with the filament extending through the slot thereof, until the cross-bar is ejected from the needle on the other side of the material. During penetration of the material, the filament is bent approximately parallel with the axis of the cross-bar until the latter is ejected from the needle. The cross bar then adopts its normal transverse position relative to the filament, thereby forming a retainer preventing the fastener from being withdrawn. For such retention, the cross-bar is normally disposed at approximately right angles to the filament, but may form any other transverse angle sufficient to prevent removal of the filament through the material.

OBJECTS OF THE INVENTION

While fasteners as described above and as disclosed in the foregoing references have enjoyed substantial commercial success and user acceptance, problems have sometimes been encountered in pushing the cross-bar and filament through the material. During insertion of the fastener, when the filament is bent approximately parallel with the cross-bar, a bulge or arc of filament material is formed near the cross-bar which is not protected by the needle and which is then forced through the material as a plunger pushes the cross-bar through the needle bore and through the opening in the material. As the bulge of the filament passes through the opening in the material, stresses are formed in the filament and in the edge of the material which can damage the material, or the filament, or both.

It is accordingly the principal object of the present invention to provide an improved needle which will minimize damage to the material or to the filament during insertion of the fastener.

BRIEF OUTLINE OF THE DISCLOSURE

The present disclosure describes an improved hollow needle for inserting flexible attachments through a material in which an upstanding flange is provided along or adjacent to one or preferably both edges of the slot in the needle. These upstanding flanges may extend the full length of the needle, but are needed only at a mid-portion thereof which is adapted to lie within the opening formed in the material during insertion of the fastener. The flanges should be upstanding with respect to the longitudinal axis of the needle to a height sufficient to protect all or a substantial portion of the bulge in the filament formed therein when the filament is bent approximately parallel to the axis of the cross-bar during insertion. Preferably the upstanding height from the internal wall of the bore should be at least about one-half the thickness of the filament and is preferably of a height equal to or slightly in excess of the filament thickness, up to about twice that thickness. The forward end of the flange or flanges facing the end of the needle should be smooth. In the case of preformed holes or easily penetrated material, the end of the needle may be blunted. For penetration resistant material, the needle should be smoothly tapered from such height to a lesser height toward a point, and preferably to a smooth or feathered edge, in order to facilitate entry of the needle into the material and to provide a smooth hole therein.

The improved needle may be made by machining, by fabrication from sheet metal, or by a combination of either technique with plastic molded parts. As shown in the cited references, the end of the needle opposite the point is provided with means for mounting it in a fastener attaching device or tool. Knives for cutting individual fasteners from an assembly of fasteners may be provided as a part of the needle or independently in the attaching device.

DESCRIPTION OF THE DRAWINGS AND PREFERRED EMBODIMENTS

Figure 1:
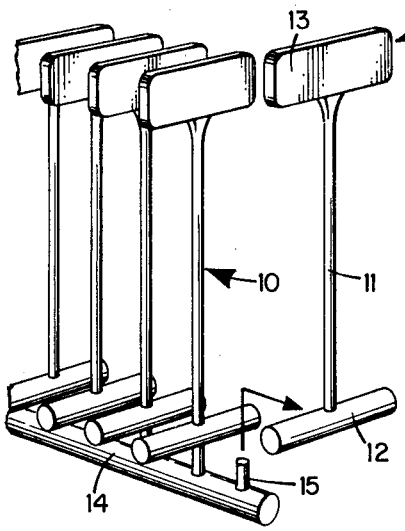
Fig. 1. PRIOR ART
FIG. 1 is a perspective view of an assembly of one type of fastener shown in the prior art, with a single fastener detached.

Referring to FIG. 1, an assembly or clip of fasteners 10 is shown, each fastener comprising a filament 11, a cross-bar 12 at one end, an enlarged head 13 at the other end, and mounted to a support rod 14 by means of a severable neck 15. The fasteners 10 normally comprise a unitary or integral article formed for example by molding from a plastic material, the filamentary portion 11 of which may be tapered and/or stretched, all as more fully described in the above-cited prior art patents, for example in U.S. Pat. Nos. 3,103,666; 3,380,122 and 3,444,597.

Figure 2:
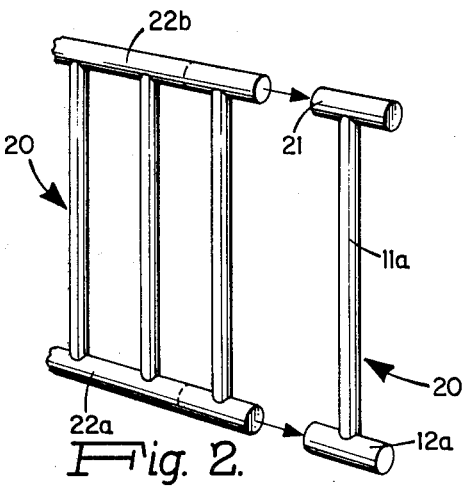
Fig. 2. PRIOR ART
FIG. 2 is a perspective view of an assembly of a second type of fastener shown in the prior art, with a single fastener detached.

Similar fasteners 20 are shown in FIG. 2 comprising a filament 11*a*, cross-bar 12*a*, and a head 21 similar to cross-bar 21*a*, bar 12*a* and head 21 being severed from continuous side members 22*a* and 22*b*, all as more fully described in U.S. Pat. No. 3,875,648.

Figure 3:
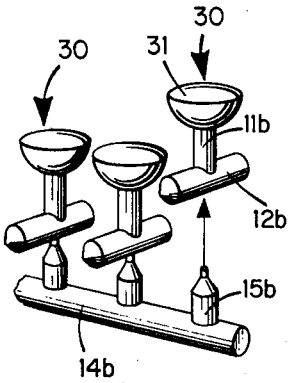
Fig. 3. PRIOR ART
FIG. 3 is a perspective view of an assembly of a third type of fastener shown in the prior art for attaching buttons, with a single fastener detached.

FIG. 3 illustrates a third form of an assembly of fasteners 30, each comprising a filament or shank portion 11*b*, cross-bar 12*b* and an enlarged tapered head 31, mounted to a support rod 14*b* by means of a severable neck 15*b*, all as more fully described in U.S. Pat. No. 3,399,432.

Figure 4:
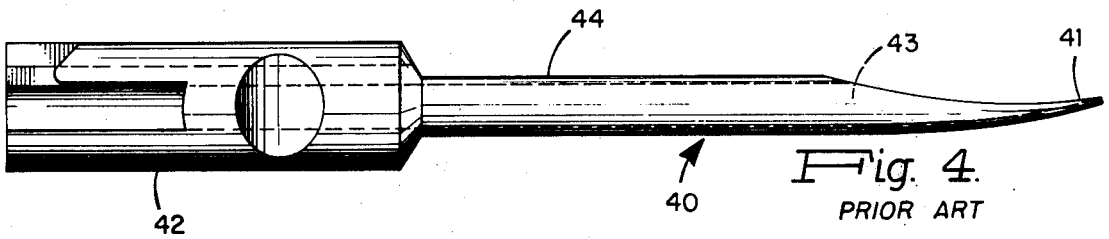
Fig. 4. PRIOR ART
FIG. 4 is a side view of a prior art needle.
Figure 5:
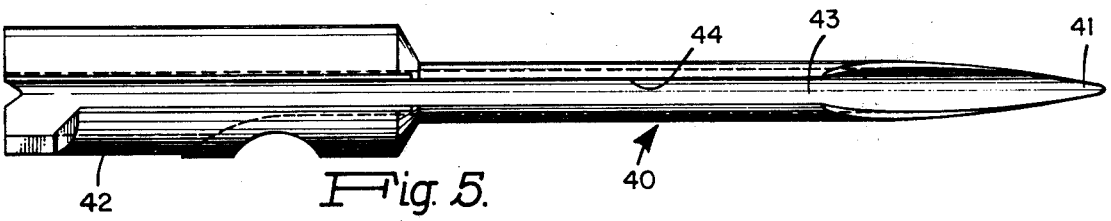
Fig. 5. PRIOR ART
FIG. 5 is a top view of the needle shown in FIG. 4.

FIGS. 4 and 5 illustrate side and top views respectively of a needle 40 more fully shown and described, for example, in U.S. Pat. No. 3,895,753. The needle illustrated comprises a point 41 at one end, an enlarged mounting portion 42 at the other end, a hollow bore 43 extending lengthwise through the needle, and a slot 44 extending lengthwise of the needle along one side of and communicating with the bore 43.

Figure 6:
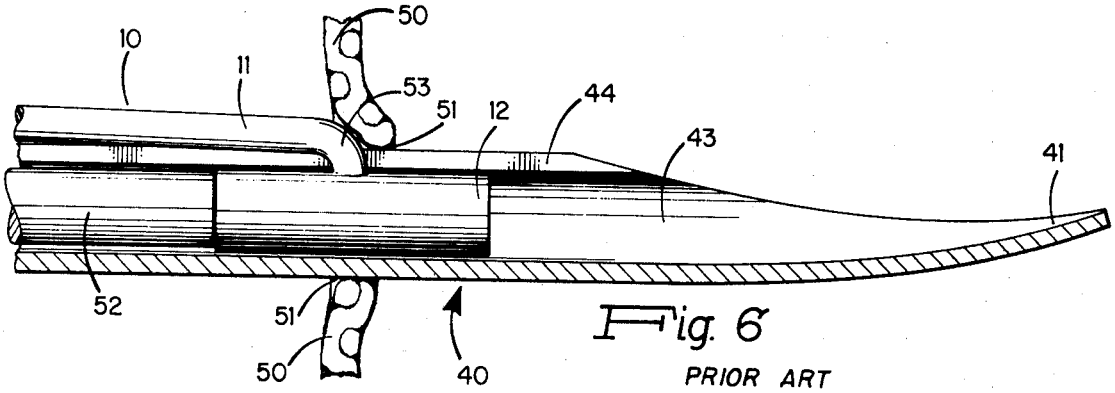
Fig. 6 PRIOR ART
FIG. 6 is a side view in section of a portion of the needle shown in FIG. 5 with a fastener located therein and inserted through an opening in a layer of material.

In accordance with the practice in the prior art, illustrated in FIG. 6, a fastener 10 (or 20 or 30) has its cross-bar 12 inserted in the bore 43 with the filament 11 extending outwardly through slot 44. The needle is inserted through one or more layers of material 50 forming an opening 51 therein. A plunger 52 is then actuated within bore 43 to force cross-bar 12 through the needle and out through the point 41. During insertion through material 50, filament 11 is bent to lie approximately parallel axially with cross-bar 12 and needle 40. When so bent, an arced or bulging portion 53 is formed which extends outwardly beyond the surface of the needle 40 and slot 44, and beyond the opening 51 formed in the material by the needle. As the plunger 52 forces the fastener through the needle, arced portion 53 forces an increase in opening 51 in material 50 thereby causing stresses in the filament 11 and in the material 50. These stresses can damage delicate materials, and tough materials such as a button or leather, or the like, can produce stresses sufficient to damage or shear the filament 11, especially at its juncture with cross-bar 12. When the cross-bar 12 is ejected from the point of the needle by the action of plunger 52, if not sheared or damaged, it will resume its transverse position with respect to the filament 11 and prevent withdrawal of the fastener through the material when the needle is withdrawn.

Figure 9:
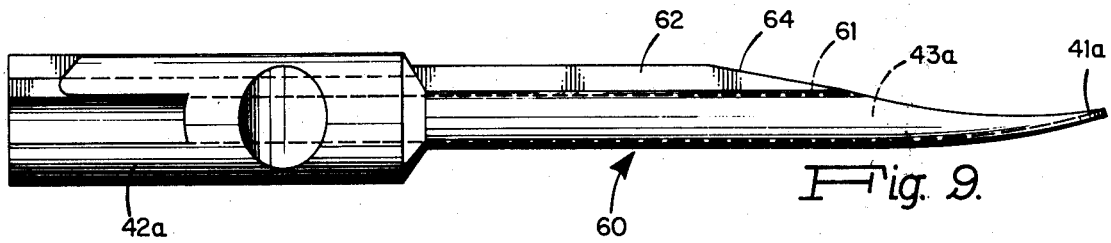
FIG. 9 is a side view of the needle shown in FIG. 8.
Figure 7:
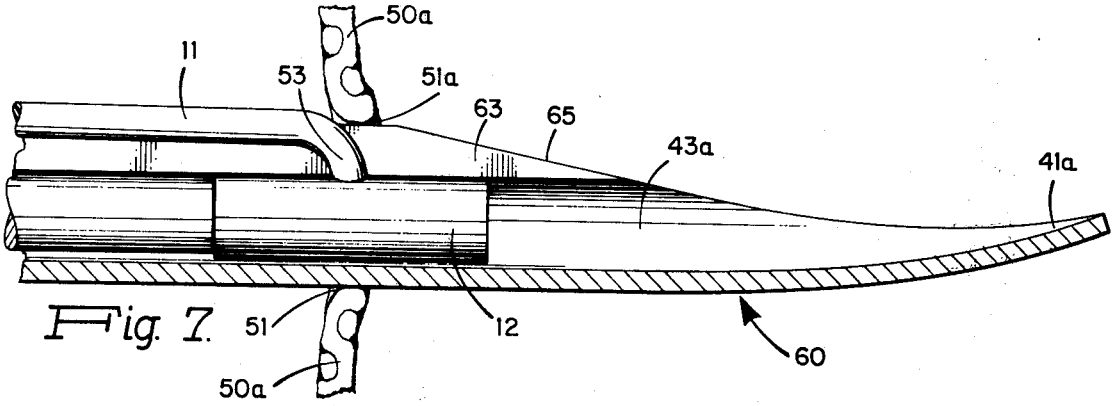
FIG. 7 is a view similar to FIG. 6 but showing the improved needle according to this invention.
Figure 8:
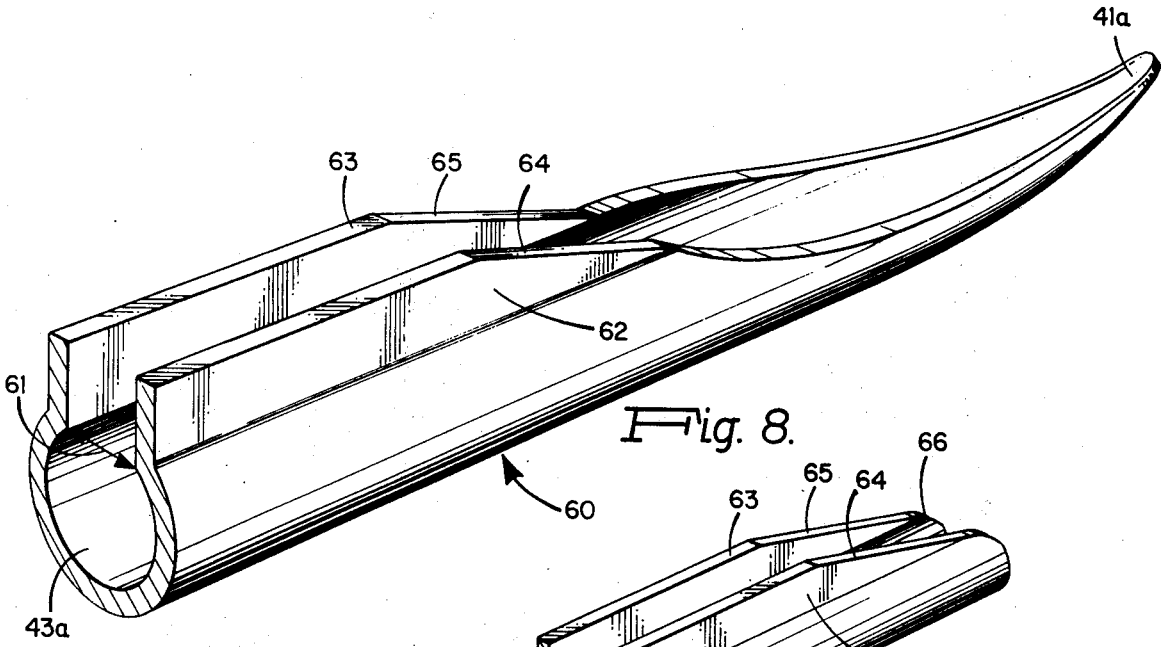
FIG. 8 is a perspective view of the improved needle shown in FIG. 7.

The preferred embodiment of the improved needle of this invention is illustrated in FIGS. 7–9. The needle 60 comprises a material having a point 41*a* at one end, mounting means 42*a* at the other end, a central bore 43*a* for slidably receiving the cross-bar 12 of a fastener, and a slot 61 communicating with bore 43*a* for slidably receiving the filament 11 of a fastener. The edges defining the slot 61 each have upstanding flanges 62 and 63 which taper at 64 and 65 downwardly to the surface of the needle at their forward portion adjacent the point of the needle 41*a*.

The operation of improved needle 60 according to the present invention is illustrated in FIG. 7 where it can be seen that the needle 60 will form a clean and somewhat larger hole 51*a* in material 50*a*. The flanges 62, 63 receive the arced portion 53 of the filament 11 therebetween and protect it and the material 50*a* from stresses induced by insertion of the fastener.

As shown, the flanges 62, 63 may extend rearwardly the length of the needle and merge with the mounting end portion 42*a*. Such extension is not necessary however, it being sufficient if the flanges extend rearwardly to a position along the needle where they will lie within opening 51*a* in material 50*a* when the needle is inserted therethrough and the fastener inserted.

Needle 60 and flanges 62, 63 may be made by any suitable procedure, including machining or molding. However, they are conveniently made by techniques illustrated in U.S. Pat. No. 3,895,753 from flat sheet metal stock in which the free edges are upwardly folded to form the flanges. The rough edges of the sheet stock are then freely exposed and can be readily polished to provide a smooth surface minimizing damage to materials through which the needle is inserted and to the filaments which are fed therebetween. In the prior art construction, the free edges of a sheet metal blank were rolled to face each other across the narrow gap of the slot and were not readily accessible for such polishing and which were disposed to contact the filament.

The needle and fasteners may be of any convenient size and shape. While round cross-sections for the needle and fastener cross-bars and filaments are preferred and shown, they can be of any other suitable shape, for example, oval or polygonal. Preferably the fastener cross-bar is somewhat larger in diameter than the filament and the size of the needle bore and slot sufficiently larger than the fastener cross-bar and filament diameters, respectively, to allow insertion and sliding movement therein. Typical dimensions for present applications are a minimum filament diameter of about 20 mils, a cross-bar diameter of about 45 to 50 mils, a needle bore of about 52 mils diameter, a needle wall thickness of about 10 mils, and a flange height from the internal wall of the bore of about 10 to 40 mils, and preferably about 25 to 35 mils.

While the flanges 62, 63 are illustrated at the edges of the slot 61, they may if desired be somewhat spaced therefrom. And while a single flange 62 or 63 can be employed in accordance with this invention, two flanges approximately parallel to each other as shown are preferred. The upstanding height of the flanges from the internal diameter of the bore should be sufficient to provide protection for the bent filament and material during insertion. Preferably this is about one-half the diameter of the filament 11 to about 2 times that diameter. Unnecessary height should be avoided to minimize the size of the opening made in material 50*a* during insertion of the needle.

While the novel flanges of this invention have been described in connection with the needle shown in U.S. Pat. Nos. 3,895,753 and 3,759,435, they can be employed with any other slotted, hollow needle useful for inserting flexible fasteners for example, the needle constructions shown in U.S. Pat. Nos. 3,103,666; 3,470,834, 3,659,769; and 3,875,648.

Figure 10:
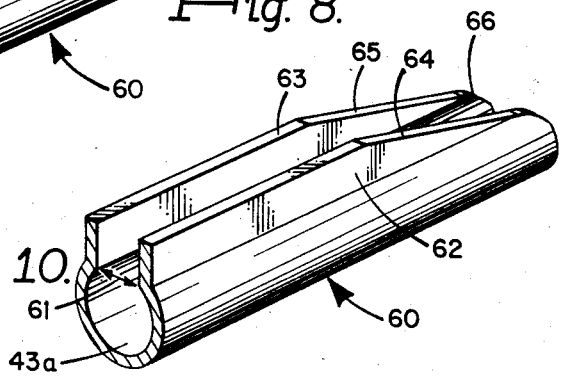
FIG. 10 is a perspective view of an alternative embodiment of the invention.

In the further embodiment of FIG. 10, the needle 60 has a blunted end 66 instead of the pointed end 41*a* shown in FIG. 8.

It should be understood that the foregoing description is for the purpose of illustration and that the invention includes all modifications and equivalents within the scope of the appended claims.

What is claimed is:

1. A hollow needle for inserting a fastener through one or more layers of material, the fastener having a flexible filament with a cross-bar at one end, the needle having a central bore for slidably receiving said cross-bar between an insertion location at the rear portion of the needle and an ejection location at the forward portion of the needle, a co-extensive slot along one side of and communicating with the bore for slidably receiving said filament, and an upstanding flange adjacent one edge of said slot and extending lengthwise along at least a portion thereof, and being adapted to protect the filament from damage during insertion of the fastener through the material.

2. A needle according to claim 1 wherein the needle has a pointed end.

3. A needle according to claim 1 wherein the needle has a blunt end.

4. A needle according to claim 2 wherein the forward edge of the flange nearest the point of the needle is tapered toward the needle to facilitate smooth penetration of the material.

5. A needle according to claim 4 wherein an upstanding flange is provided adjacent both edges of the slot, the flanges being spaced apart to receive the filament therebetween during insertion of the fastener through the material.

6. A needle according to claim 3 wherein an upstanding flange is provided adjacent both edges of the slot, the flanges being spaced apart to receive the filament therebetween during insertion of the fastener through the material.

7. A needle according to claim 5 wherein the flanges are of an upstanding height between about one-half and twice the thickness of the filament.

8. A needle according to claim 6 wherein the flanges are of an upstanding height between about one-half and twice the thickness of the filament.

9. A hollow elongate needle for inserting a fastener through one or more layers of material, the fastener having a flexible, resilient filament with an integral cross-bar at one end, the needle comprising means for mounting it in a tool at one end, a central bore for slidably receiving said cross-bar between an insertion location at the rear portion of the needle and an ejection location at the forward portion of the needle, a co-extensive slot along one side of and communicating with the bore for slidably receiving said filament, and an upstanding flange at each edge of said slot adapted to protect the material and filament from damage during insertion of the fastener, the flanges extending lengthwise of the slot along at least a mid-portion thereof adapted to penetrate said material and being tapered toward the surface of the needle at their forward ends nearest the point, the flanges being spaced apart to receive the filament therebetween and having an upstanding height between about one-half and twice the thickness of the filament.

* * * * *